US008915497B2

(12) United States Patent
Machamer

(10) Patent No.: US 8,915,497 B2
(45) Date of Patent: Dec. 23, 2014

(54) METHOD AND APPARATUS FOR SHEET AND CARTON BLANK ALIGNING USING CASTER EFFECT

(71) Applicant: Tamarack Products, Inc., Wauconda, IL (US)

(72) Inventor: David E. Machamer, Wauconda, IL (US)

(73) Assignee: Tamarack Products, Inc., Wauconda, IL (US)

( * ) Notice: Subject to any disclaimer, the term of this patent is extended or adjusted under 35 U.S.C. 154(b) by 0 days.

(21) Appl. No.: 14/147,945

(22) Filed: Jan. 6, 2014

(65) Prior Publication Data

US 2014/0191465 A1 Jul. 10, 2014

Related U.S. Application Data

(60) Provisional application No. 61/748,953, filed on Jan. 4, 2013.

(51) Int. Cl.

| | |
|---|---|
| ***B65H 9/16*** | (2006.01) |
| ***B65H 9/00*** | (2006.01) |
| ***B65H 5/22*** | (2006.01) |

(52) U.S. Cl.

CPC ..... *B65H 9/002* (2013.01); *B65H 5/0068* (2013.01); *B65H 5/224* (2013.01)

USPC ..... 271/251; 271/248; 271/249; 271/250; 271/252

(58) Field of Classification Search

CPC .... B65H 9/166; B65H 9/163; B65H 2404/14; B65H 5/062; G06K 13/063

USPC ..... 271/248–254

See application file for complete search history.

(56) References Cited

U.S. PATENT DOCUMENTS

| | | | | |
|---|---|---|---|---|
| 3,439,793 | A | 4/1969 | Rakestraw | |
| 3,690,222 | A | 9/1972 | Schroeder | |
| 4,387,890 | A | 6/1983 | Lampe | |
| 4,519,700 | A * | 5/1985 | Barker et al. | 399/394 |
| 4,738,442 | A | 4/1988 | Rodi et al. | |
| 4,995,504 | A * | 2/1991 | Kuhn | 198/408 |
| 5,169,140 | A | 12/1992 | Wenthe, Jr. | |

(Continued)

FOREIGN PATENT DOCUMENTS

| | | | | |
|---|---|---|---|---|
| JP | 52069159 A * | 6/1977 | | B65H 9/16 |
| JP | 61055046 A * | 3/1986 | | B65H 9/16 |

*Primary Examiner* — Prasad Gokhale

(74) *Attorney, Agent, or Firm* — Greer, Burns & Crain, Ltd.

(57) ABSTRACT

An improved apparatus and method for properly orienting and aligning flat sheets or strip material, such as in the form of folding carton blanks, on a conveying system such as used in carton folders/gluers is disclosed. A moving sheet is engaged on at least one surface by plural non-driven movable casters oriented at an angle relative to the sheet's intended direction of travel, or target direction. The casters apply a lateral force to the sheet so that a linear lateral edge of the sheet is brought into contact with an adjacent guide member aligned with the target direction, with the sheet assuming a predetermined orientation relative to the target direction. Each caster is resiliently biased such as by a spring at a predetermined angle relative to the target direction. With the sheet's lateral edge in intimate contact with the guide member, the moving sheet is in the aforementioned predetermined orientation relative to, and is displaced in, the target direction.

26 Claims, 8 Drawing Sheets

(56) References Cited

U.S. PATENT DOCUMENTS

| | | | | |
|---|---|---|---|---|
| 5,400,706 | A | 3/1995 | Tipton et al. | |
| 5,407,191 | A | 4/1995 | Ukai | |
| 5,960,933 | A | 10/1999 | Albrecht | |
| 6,162,157 | A | 12/2000 | Morisod | |
| 6,164,643 | A * | 12/2000 | Otsuka | 271/250 |
| 6,269,995 | B1 | 8/2001 | Rich et al. | |
| 6,276,586 | B1 | 8/2001 | Yeo et al. | |
| 6,637,634 | B1 | 10/2003 | Yeo et al. | |
| 6,772,663 | B2 | 8/2004 | Machamer | |
| 7,901,533 | B2 | 3/2011 | Steidinger | |
| 8,074,977 | B2 * | 12/2011 | Greinwald | 271/13 |
| 2002/0074717 | A1 | 6/2002 | Schlageter | |
| 2003/0075861 | A1 * | 4/2003 | Sussmeier | 271/251 |
| 2005/0248081 | A1 * | 11/2005 | Gaissert et al. | 271/251 |
| 2009/0160125 | A1 * | 6/2009 | Fujita et al. | 271/227 |
| 2010/0327519 | A1 * | 12/2010 | Miyazawa | 271/248 |
| 2011/0156345 | A1 | 6/2011 | deJong et al. | |
| 2012/0098879 | A1 | 4/2012 | Mandel et al. | |
| 2013/0113158 | A1 * | 5/2013 | Miyazawa | 271/227 |
| 2013/0168922 | A1 | 7/2013 | Machamer | |

* cited by examiner

PRIOR ART FIG 1a
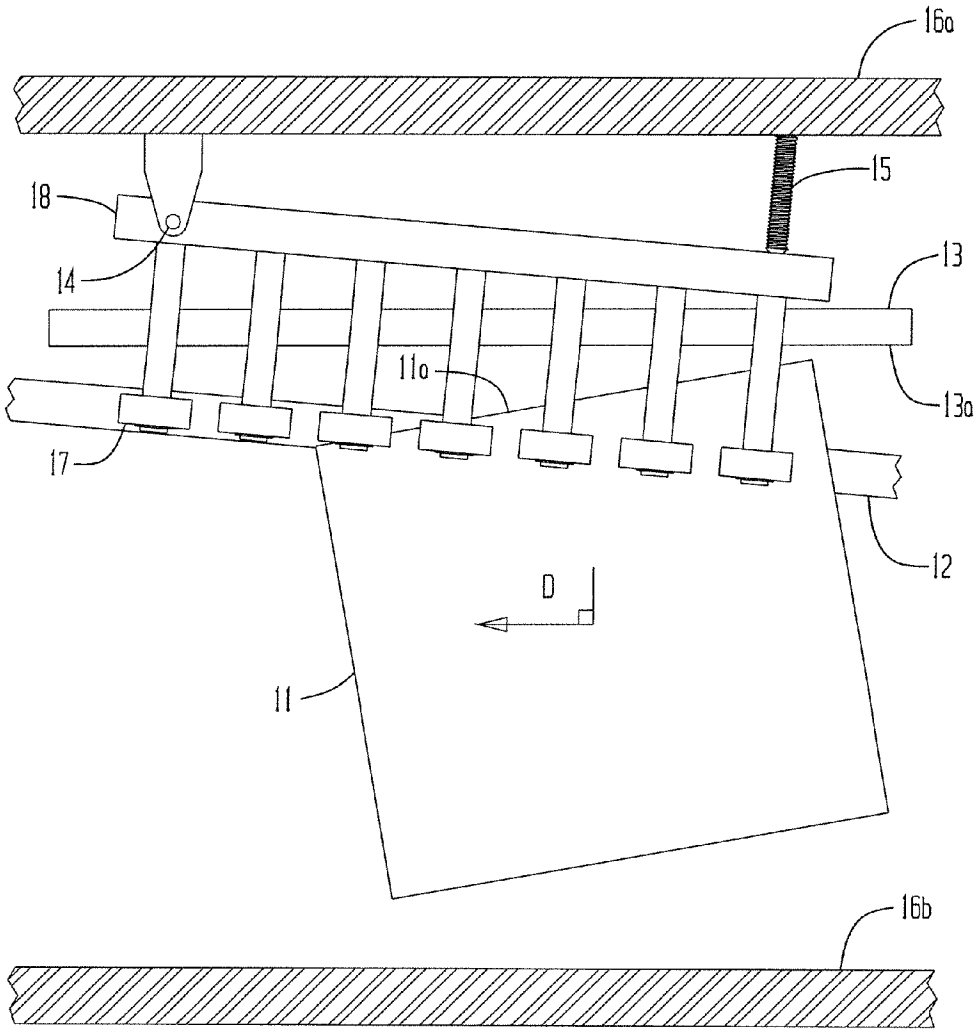

PRIOR ART FIG 1b
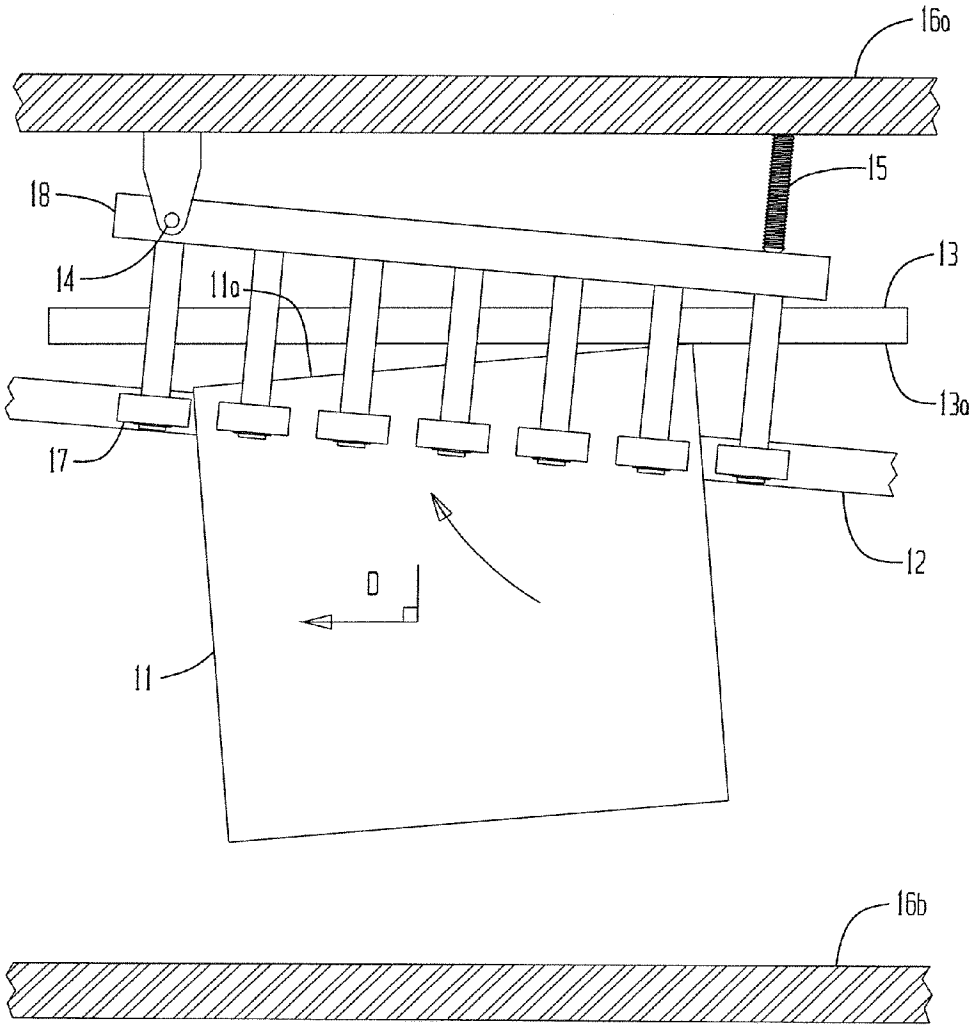

PRIOR ART FIG 1c
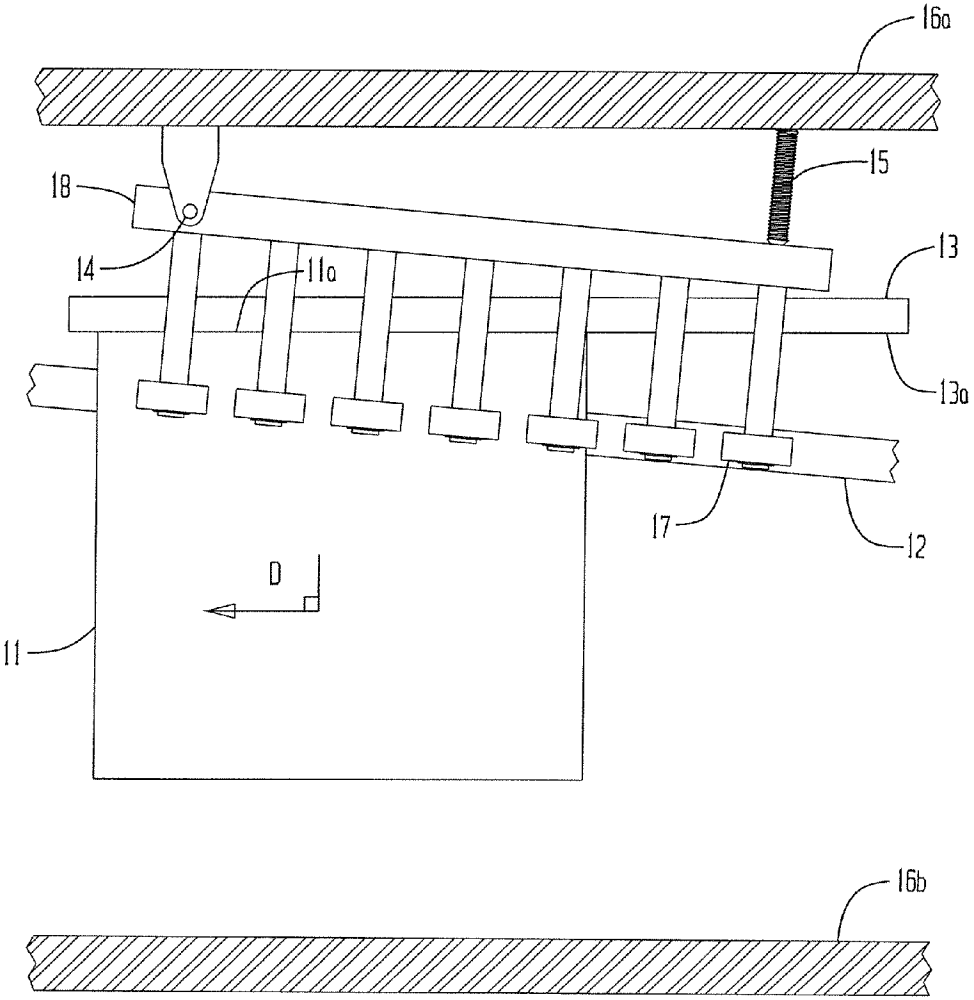

PRIOR ART FIG 2
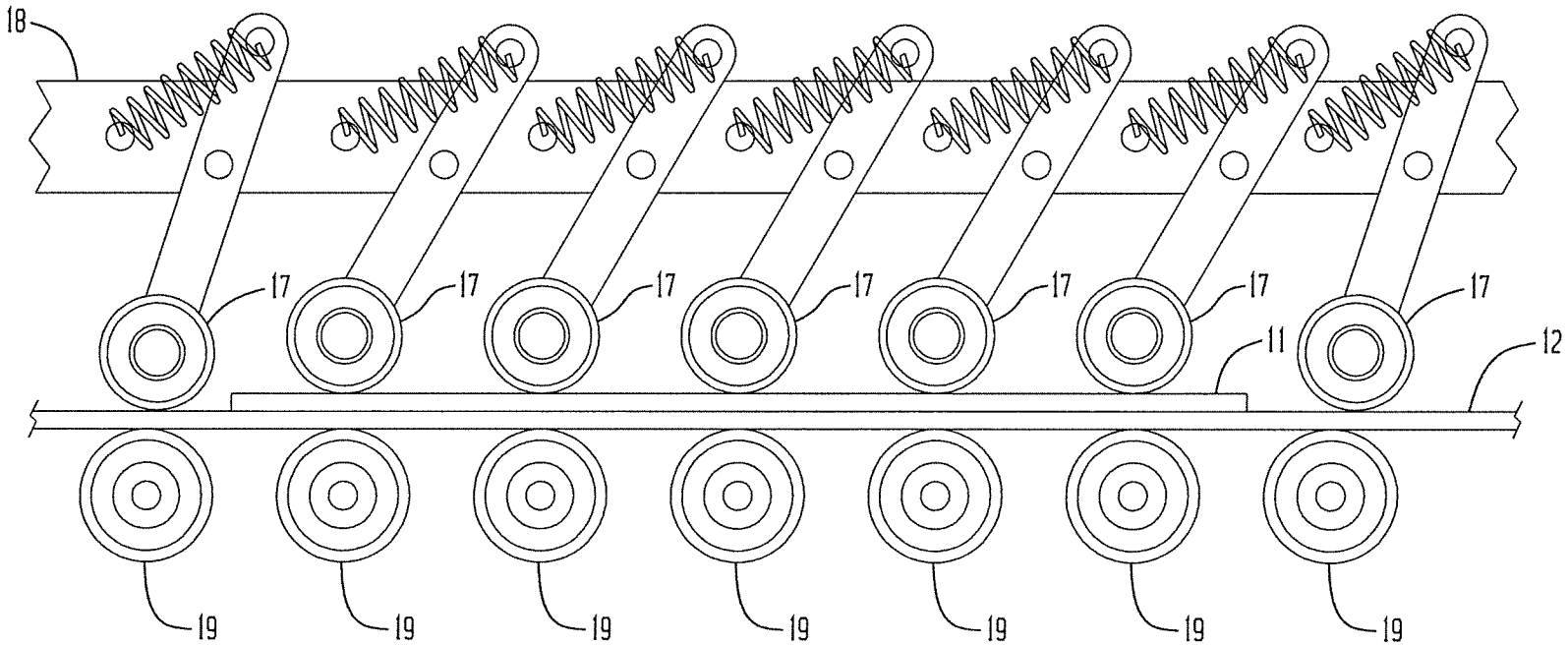

METHOD AND APPARATUS FOR SHEET AND CARTON BLANK ALIGNING USING CASTER EFFECT

RELATED APPLICATION

The present application claims 35 USC 119(e) priority from U.S. Provisional application Ser. No. 61/748,953 filed Jan. 4, 2013.

Portions of this disclosure are included in U.S. Provisional Application No. 61/581,505 filed Dec. 29, 2011, which is now U.S. patent application Ser. No. 13/685,801 filed on Nov. 27, 2012.

BACKGROUND OF THE INVENTION

In processes involving printing on sheets of material such as paper, or processing folding carton blanks, it is typically desirable that in the case of a rectangular sheet or blank that the side edges of the sheet or blank are parallel to the conveying direction and/or the leading edge is perpendicular to the conveying direction. This allows operations such as printing to be properly oriented with respect to the sheet or blank. In carton folding/gluing operations, flat carton blanks are folded along score lines and glued along a seam or at a corner or corners to provide a carton ready for subsequent uses such as erecting or filling. Carton folder/gluers typically include a feeder which dispenses a flat, die-cut carton blank from the bottom of a stack of blanks. These feeders often do not dispense a carton blank with the desired orientation alignment because of many factors, e.g., asymmetry of carton shape and uneven weight distribution in the feeder, varying feeder belt friction coefficients, differences in feed gate settings and other factors. Immediately after leaving the feeder, cartons are gripped by carrier belts. To create a desired spacing between each carton blank on the carrier belts, the carrier belts run faster than the feeder belts. This creates a brief 'tug of war' while the carton is released by the slower moving feeder belts and engaged by the faster moving carrier belts. The feeder and carrier belt positioning is often asymmetric with respect to the carton and this 'tug of war' can cause a carton blank to twist out of the desired orientation.

Folder/gluer operators strive to make cartons feed "square" or "aligned", i.e., in the desired orientation with the conveying direction on carrier belts. This requires a high degree of operator skill based on years of experience.

To reduce the level of operator skill required to some extent and to better assure proper orientation regardless of machine parameters that often vary during operation, carton folders/gluers often include a carton aligner or aligning section. In prior art aligning processes, the sheets or carton blanks have been conveyed by carrier belts with overlying balls or rollers that lightly grip the sheet or blank and laterally urge the sheet or blank against a mechanical guide comprised of an adjustable steel plate with a smooth, flat surface. This section of the machinery is known as an aligning section. The loose contact between belts and rollers allows the sheet to shift so that it can become aligned with respect to the guide which typically sets one side edge of a blank parallel with subsequent lower carrier belts and upper gripping belts or rollers. This is intended to desirably align the sheet or blank for subsequent operations.

There are some drawbacks to the prior art method of aligning:

Set up of the aligning section involves adjusting numerous components and variables and requires an experienced operator.

The sheet or blank is not firmly gripped or controlled during the aligning process. Thus the speed and position of the blank in the aligning section is not well defined, repeatable, or predictable. There are some subsequent processes such as applying adhesive with systems provided by Nordson of Westlake, Ohio or applying window film patches with windowing systems such as provided by Tamarack Products of Wauconda, Ill. that require the speed and position of the blank to be known so that subsequent speed and position can be accurately predicted. For example, the Tamarack® Vista® windowing machine uses a scanner approximately two feet ahead of the Vista windower to sense carton position. Carton speed is indirectly sensed by an encoder that measures the speed of a lower carrier belt. During aligning, substantial slippage occurs between the blank and the carrier belts in the aligning section, the carton speed will not be sensed properly, the blank's subsequent position will not be predicted accurately, with the result that the window application position will not be accurate. For these applications, the carton blank must be sensed later in the process, after aligning. This means the scanning of the blank must occur later in the folder/gluer and this can result in an undesirable or impractical location for the Vista windower.

SUMMARY OF THE PRIOR ART

The machines in the web pages listed below use a typical alignment guide bar and angled rollers or belts to urge a carton blank against the guide bar.

Various means are used to drive the blank, while at the same time allow the blank to shift to bring one edge of the blank into compliance with the guide bar.

http://www.aim-inc.net/new_machines/elite.cfm http://www.robertspolypro.com/products/folder-gluer/

U.S. Pat. No. 6,162,157 to Morisod shows an alignment device that, while using a traditional guide bar 100, also uses air flow to lightly contact and urge blanks of "low specific gravity", partly folded blanks and other delicate blanks against an angled belt which otherwise traditionally urges the blank against the guide bar.

The aforementioned Provisional Application No. 61/581,505 to Machamer uses two scanners to sense the lead edge of the blank. The signals from the scanner are fed to a processor which evaluates the timing difference (or the difference in master encoder or virtual master pulses) between each scanner's signal. Two sets of grippers engage each sheet or blank towards its side edges. The grippers are capable of operating at different speeds via a differential drive or electronically controlled servo drives. Differing speeds are commanded at each gripper in order to steer or rotate the blank relative to subsequent carrier belts.

OBJECTS AND SUMMARY OF THE INVENTION

In my previous application (Provisional Application No. 61/581,505), a novel aligner using servo-driven gripper wheels to steer and align the carton blanks works well in practice. However, the servo drive used in at least one embodiment is relatively expensive.

An effective aligner, that also provides a firm grip and control of the blanks during alignment, has been developed using simpler, less costly components. Further, the improved aligner system can be largely adjusted by the manufacturer and requires no programming or entry of parameters by an operator and little subsequent mechanical adjustment on the part of an operator. This substantially lowers the skill level required of an operator, as well as improving the productivity of the operator and the equipment.

Carton blanks or sheets are conveyed on vacuum belt cartridges as is known. The blanks are generally held in contact with belts via vacuum supplied through or between belts, however, the contact with the belts is light enough to allow the cartons to shift or twist on the belts when an aligning force is applied.

The blanks carried on the vacuum belt may be undesirably skewed or angled relative to the vacuum belts. The blanks may also be laterally out of position for subsequent operations such as longitudinal folding. Or, the blanks may have a combination of skew and lateral displacement. Both skew and lateral displacement are considered errors in position that will later cause errors in the process, such as incorrectly positioned longitudinal folds, window films, or glue lines.

In one embodiment of the improved apparatus, a series of upper and lower castered or bias-angled rollers or wheels are positioned adjacent the vacuum belts. The carton blanks are gripped firmly by the upper and lower wheels. The initial angle of the wheels causes a sidewards force that urges the blank against a side guide. The side guide may be a stationary straight edge as is known, or a moving belt. The moving belt may be driven with pulleys having rotational axes either horizontal or vertical, i.e., to engage the edge or the flat side of the belt, respectively, and provides both an alignment side guide and a driving surface. The moving belt advantageously minimizes friction acting against the blank, compared to a typical stationary side guide.

The upper and lower wheels are mounted on pivots. The pivots are positioned ahead, or upstream, of the wheels so that each wheel can swivel to align with the direction of motion of the blanks in a manner similar to a caster wheel on a shopping cart. However, at least some of the upper and lower wheels are biased or angled toward the side guide by a spring acting on each wheel assembly.

As each blank is gripped by an upper and lower wheel, the blank is generally moving parallel to the vacuum belt(s). The upper wheel attempts to swing on its pivot and align itself with the direction of motion of the carton, however, that aligning tendency is resisted by the spring. The resulting lateral force pulls both the upper and lower wheels and in turn pulls the blanks towards the side guide. Once the blank is rotated and/or laterally displaced against the side guide, the blank can no longer be further displaced and it continues along the vacuum belts in alignment with the side guide. At this time, the upper and lower wheels caster, or align, themselves parallel to the side guide. At the end of the aligner section, the blank enters typical upper and lower carriers in state of the art folder/gluers and then leaves the upper and lower wheels (and also the side guide) and tends to remain in the desired orientation and position defined by the side guide. This allows subsequent operations such as folding, windowing, and gluing to be performed in the desired locations and positions on the blanks.

The instant invention provides a number of advantages over prior art methods and apparatuses.

The castered wheel assemblies of the instant invention are relatively inexpensive compared to the servo-driven system of the earlier Provisional Application No. 61/581,505. The instant invention requires no servo programming or operator interface such as a touch screen.

The castered wheel apparatus requires little operator set up or intervention, a major benefit for the operator and productivity.

The castered wheel assemblies and side guide allow a firm grip of the blanks during the aligning process so the longitudinal speed of the blanks remains nearly constant. The firm grip of the wheels on the blank provide a substantial transverse force against the side guide belt. In embodiments where the guide belt is driven at the intended conveying speed, this provides a positive driving force on the carton blank. This positive drive means that the blank's speed is matched to the conveying speed and allows the blank's longitudinal position to be sensed during alignment, and its speed will closely match the guide belt speed so that the carton blank's subsequent speed and position may be accurately predicted; an important benefit that assures accuracy for subsequent timed operations such as gluing and windowing. The freedom to sense the position of the blanks during (instead of after) alignment allows a wider choice of installation position for windowing equipment such as a Tamarack Vista window applicator and may also eliminate the need to lengthen the folder/gluer to provide enough length to perform the position sensing ahead of the window film equipment—typically about two feet upstream of window application. So, the new invention has a clear advantage over prior art alignment mechanisms which require a relatively light contact with the blank so the blank can slip during the aligning process—in contrast, the new invention provides a firm grip on the carton blank during the aligning process and so that the blank's speed and position can be accurately established during aligning, instead of after aligning. While this advantage of allowing the sensing of carton position at an earlier point in the folder gluer machine is similar to the servo-driven system of Provisional Application No. 61/581,505, this new invention achieves it with a significantly simpler, lower cost, and easier to use apparatus.

The side aligning force can be easily limited by selecting 'light' springs, i.e., springs having a relatively small spring constant, or by adjustably loaded springs. This allows the instant invention to be readily used with sheets of paper which have a relatively low stiffness relative to bending. In other words, the instant invention can be adjusted so that relatively lightweight sheets or carton blanks can be aligned without buckling the sheets as they contact the side guide. The possibility of sheet buckling may also be reduced by placing the castered wheel assemblies in close proximity to the side guide.

The driven belt side guide reduces or eliminates any drag on the carton blank during the alignment process, as does to a slightly lesser extent a non-driven but idled belt or roller side guide. This reduction in drag or friction is not to be underappreciated—the fixed side guide plate of a prior art aligner can become far too hot to touch due to friction between the blanks and the fixed side guide. This reduction of friction further minimizes carton blank slippage in the longitudinal direction and again allows for more reliable position sensing. The reduced drag also reduces any tendency to buckle a corner or edge of a relatively delicate carton blank or sheet.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

FIGS. 1*a*, 1*b*, 1*c* represent a progression of schematic top views of the prior art apparatus and method for aligning folding cartons.

FIG. 2 illustrates a schematic partial side view of the prior art apparatus.

DETAILED DESCRIPTION OF THE PREFERRED EMBODIMENTS

Prior Art

Figure 3:
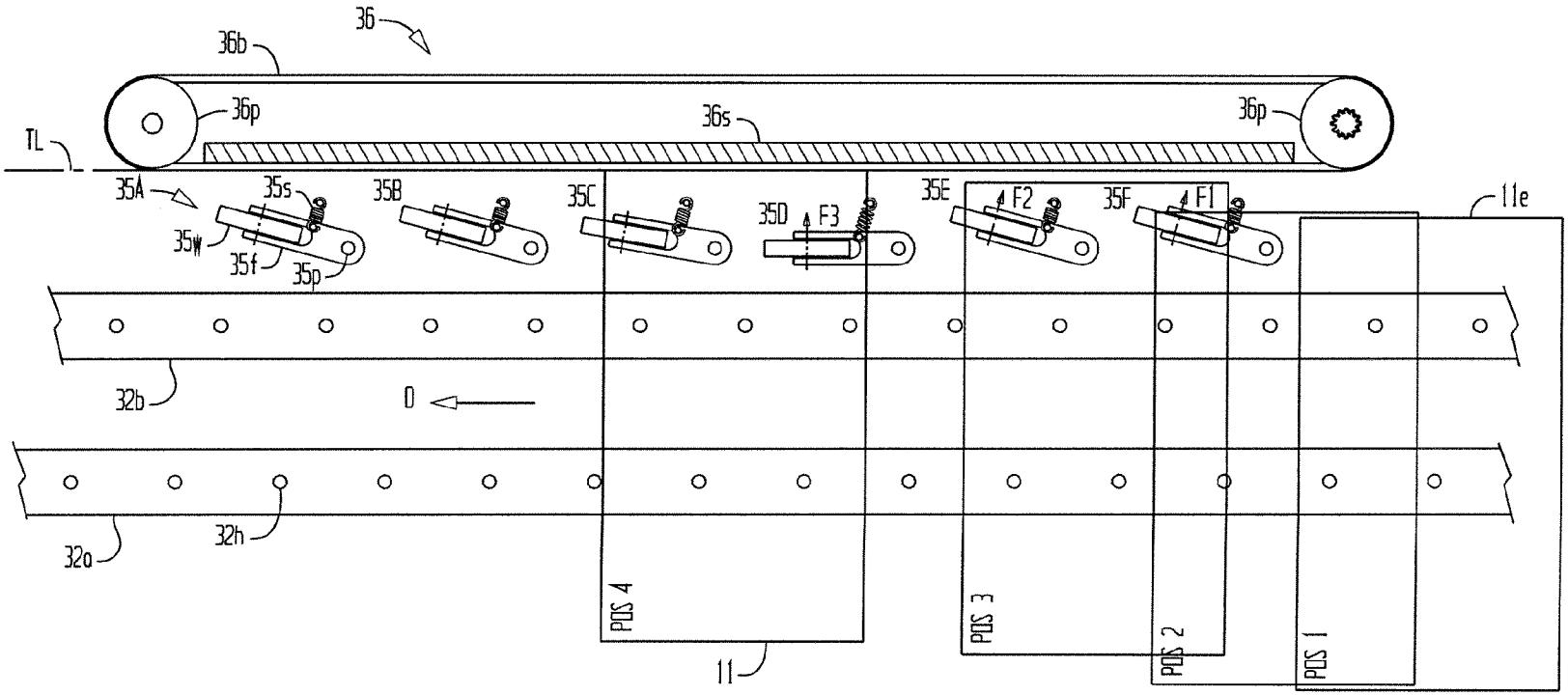
FIG. 3 is a schematic top view of the inventive apparatus for aligning sheets and folding cartons that illustrates the carton blank in four sequential positions.

FIGS. 1*a* and 1*b* show a top view schematic of a prior art carton aligner used with prior art carton folder/gluers such as those provided by American International Machinery of Oak Creek, Wis., Bobst of Lausanne, Switzerland and Heidelberger Druckmaschinen AG of Heidelberg, Germany. Carton blank 11, shown here in a skewed orientation relative to its intended conveying direction D and is carried on driven carrier belt 12. Carrier belt 12 is typically driven by drive pulleys on a drive shaft via a motor drive system (not shown). In FIG. 1*a*, side edge 11*a* of blank is about to contact alignment bar 13. Guide bar 13 is supported by side frame 16*a*, by conventional means, not shown. Blank 11 is driven towards aligning surface 13*a* of bar 13 by a series of rollers 17 that are held on an adjustable frame 18 via pivot 14 and adjuster 15. The frame 18 is supported by side frame 16*a*. The rollers 17 are shown in an angled orientation relative to side frames 16*a*, 16*b* and guide bar 13 such that the rollers develop a side force that urges blank 11 towards alignment bar 13 so that carton edge 11*a* is crowded or pushed into contact with alignment edge 13*a*. Unlike carrier belt 12, rollers 17 are not directly driven. Rather, rollers 17 rotate by virtue of frictional contact with the carton blank 11 and if the blank is absent, by contact with carrier belt 12.

FIG. 1*b* shows a subsequent moment in time in relation to FIG. 1*a*. Carton blank 11 has moved to the left, or downstream, and has rotated clockwise as a result of contact with guide bar 13 and the side force caused by the skewed rollers 17.

FIG. 1*c* illustrates a still later moment in time. Carton blank 11 has rotated and come into contact with aligning edge 13*a* so that carton 11 is now traveling parallel to aligning edge 13*a*, which is typically also parallel with side frames 16*a* and 16*b*. Edge 13*a* defines the desired carton 11 conveying direction D. Edge 13*a* also defines the lateral position of carton edge 11*a* relative to side frames 16*a*, 16*b* so that subsequent operations such as folding at various scores, window application, labeling, die cutting, and other operations known in the art (but not shown here) can be performed at the desired lateral locations on carton blank 11.

FIG. 2 is a side view schematic of the prior art apparatus of FIGS. 1*a-c*. Carrier belt 12 is supported by rollers 19. Rollers 17 are spring loaded to grip the carton blank 11 between rollers 17 and carrier belt 12. The grip of the rollers 17 and belt 12 on the carton blank 11 is adjustable so that the blank is driven forward (to the left relative to FIGS. 1*a-c* and FIG. 2) in the folder gluer reliably and also driven against the alignment bar 13, but not so tightly that the carton blank is deformed against the alignment bar 13 by excessive side forces. Also the carton blank must be lightly enough gripped to allow the carton blank 11 to rotate (relative to the plane illustrated in FIGS. 1*a-c*) into the desired orientation with alignment edge 13*a*. The requirements for positively driving the blank forward while allowing it to slip so it can be aligned are at cross-purposes and require skilled operator adjustment for a particular job. For more reliable performance, the alignment bar 13 and frame 18 with angled rollers 17 are quite long and an aligning module to support the aligning components typically adds about 3-4 ft to the length of an already long and sizable carton folder/gluer. While the carton blank is in the alignment section, the twisting and slippage of the carton blank means that its speed and position are not accurately defined or predictable. This can interfere with operations like in-line window affixing such as provided by the Vista window applicator of Tamarack Products Inc of Wauconda, Ill. whose operation is disclosed in U.S. Pat. Nos. 6,772,663 and 7,901,533, the disclosures of which are incorporated herein.

Inventive Method and Apparatus:

FIG. 3 is a schematic top view of the inventive apparatus for aligning sheets and folding carton blanks. Carton blank 11 is shown in four sequential positions, Pos. 1, 2, 3, 4. Carton blank 11 has a side or lateral edge 11*e*. It is desirable that edge 11*e* be oriented parallel to an intended blank direction D. It is also desirable that edge 11*e* be positioned in a known and repeatable lateral position so that subsequent operations such as longitudinal folding or windowing may be accurately positioned. In Position 1 the carton blank is laterally out of position but no skew is shown for the purpose of simplification. The inventive aligner can correct both lateral position error and/or skewing error. Carton blank 11 is conveyed on vacuum belts 32*a* and 32*b*. Vacuum belts are known in the art of conveying sheets and carton blanks. Openings in the belts such as 32*h* are provided to allow vacuum, e.g., air at a pressure below normal atmospheric pressure, to communicate from a source (not shown) below the belt, through the belt, and with the atmosphere if the holes 32*h* are not covered with a carton blank. When a carton blank 11 covers vacuum holes, the difference in pressure causes the blank 11 to be forced onto the belts so the carton blank 11 may be conveyed by belts 32*a*, 32*b* in an intended direction D. In other embodiments, the belts 32*a*, 32*b* do not need holes such as 32*h*. Instead each belt 32*a* may be replaced by a plurality of belts running parallel but with a gap of, e.g., ⅛" between their inner edges so that the vacuum source may communicate with the atmosphere via the gap between the belts. This is also known in the art of conveying sheets and carton blanks. In another embodiment, belts 32*a*, 32*b* need not utilize vacuum at all, rather, belts 32*a*, 32*b* may be lower carrier belts and at least one upper carrier belt may be located in an opposing manner above one or more lower carrier belts so that blank 11 is gripped therebetween as is typical in the art.

A series of gripper wheel assemblies such as 35A-35F are provided to grip carton blank 11 as it moves along the aligner apparatus. Each wheel 35*w* is supported by a pivoting frame 35*f* which can pivot on pivot pin 35*p*. The supporting framework for the gripper wheel assemblies is not shown, but the framework is typically connected to the guide 36. Supporting framework is understood in the art and deleting it in the following schematic figures allows the method of operation to be more easily shown. Each wheel assembly 35 is held at an angle relative to intended blank direction D by a biasing spring 35*s*. Not shown in this view are opposing wheel assemblies below each wheel assembly 35. This provides a pair of upper and lower wheels such that each blank 11 is gripped therebetween. When blank 11 is gripped by a wheel assembly 35, the wheel assembly will try to swing in alignment with the direction of travel of blank 11 much like the caster wheel of a shopping cart swings with the direction of travel of the cart.

A side guide 36 is provided to provide a lateral edge guide for the blank 11 and defines a target line TL with which blank lateral edge 11*e* is to be parallel and coincident with. It is known in the art to provide an adjustable but stationary side guide, however, use of a moving belt as an edge guide is novel in the folding carton alignment art. In one embodiment of the current invention, a moving belt 36*b* is provided and the belt is supported on pulleys 36*p*. Pulleys 36*p* may be unpowered, a.k.a. idling, or pulleys 36*d* may be driven so that the belt 36*b* surface speed is essentially the same as blank 11 speed in intended direction D. Driving the belt 36*b* to run at essentially the same speed as the carton blanks reduces friction relative to the blank 11 which may be beneficial in avoiding damaging, e.g. wrinkling or buckling a corner of blank 11 that first contacts belt 36*b* if carton 11 is skewed. Reducing friction relative to carton blank 11 also reduces or eliminates the tendency of blank 11 to undesirably twist or skew as a result of contact with a stationary guide 36. In another embodiment, unpowered pulleys may be suitable in the case where blank 11 is relatively thick and stiff so that the driving forces required to move the belt 36*b* are small compared to the forces which might buckle a corner or edge 11*e* of blank 11 when it contacts the belt 36*b*.

In general, it is desirable that wheel assemblies 35 are in relatively close proximity to guide 36 thus increasing the effective stiffness of blank 11 to avoid bending or buckling of the blank 11 between wheels 35 and guide 36.

It is also desirable that the wheel assemblies 35 and guide 36 be adjustable in terms of their proximity to conveying belt 32*b* to allow for blanks of various shapes and sizes.

In position 1, blank 11 is conveyed by belts 32*a*, 32*b* and has not yet entered any gripper wheel assemblies 35.

In position 2, blank 11 has just been gripped by one of the gripper assemblies, 35F.

In position 3, two of the gripper assemblies, 35E and 35F are in contact with blank 11. The angle of the wheel relative to intended direction D causes a side force F1 at 35F and F2 at 35E. The wheel assemblies 35E and 35F try to swing into alignment with intended direction D on pivot 35*p*, however spring 35*s* provides a resisting force. This results in a lateral force on blank 11. The lateral force becomes sufficient to overcome the frictional force provided by vacuum belts 32*a*, 32*b* on blank 11, so that blank 11 begins to move laterally towards the side guide 36. Spring 35*s* begins to extend as the wheel assemblies 35E and 35F begin to pivot away from the side guide 36 as a result of the lateral force exerted by wheel assemblies 35E and 35F.

In Position 4, the blank 11 has moved laterally into contact with guide belt 36*b* and is now "aligned", that is, aligned in the desired orientation and with its lateral edge 11*e* traveling on the intended line TL, i.e., along the line defined by the guide 36. A guide stop 36*s* serves as a stop or back up bar to belt 36*b* so that the belt is not deflected undesirably by the side force acting against belt 36*b* caused by biased wheels 35C and 35D acting through blank 11. Guide stop 36*s* could be a row of wheels to reduce friction and power consumption. As a consequence of blank edge 11*e* contacting the guide belt 36*b* wheel assembly 35D has swung so that it is approximately parallel with the intended direction of blank 11 motion. The corresponding spring 35*s* has extended further than the spring 35*s* for wheel assemblies 35E and 35F in Pos. 3, generating force F3. The spring constant is chosen so that the blank 11 is laterally shifted with respect to its original position, Pos. 1, on the belts 32*a* and 32*b*, yet is not buckled by side force F3. Wheel assembly 35*c* has recently engaged blank 11 in Pos. 4 and it has not yet swung parallel to TL, but it will swing parallel so long as blank 11 remains against guide 36.

A very similar aligning action will occur if the blank is skewed, i.e., rotated clockwise or counterclockwise with respect to the plane defined by belts 32*a* and 32*b* or blank 11. As will a similar aligning action occur if the blank 11 is skewed and laterally displaced away from guide 36.

Generally, an operator will set up a carton feeder (not shown, but known in the art) so that blank edge 11*e* is intentionally offset somewhat away from target line TL. However the inventive aligner will also tolerate to some extent a blank edge 11*e* that is already interfering with target line TL, as will further be disclosed in FIG. 6.

Figure 4A:
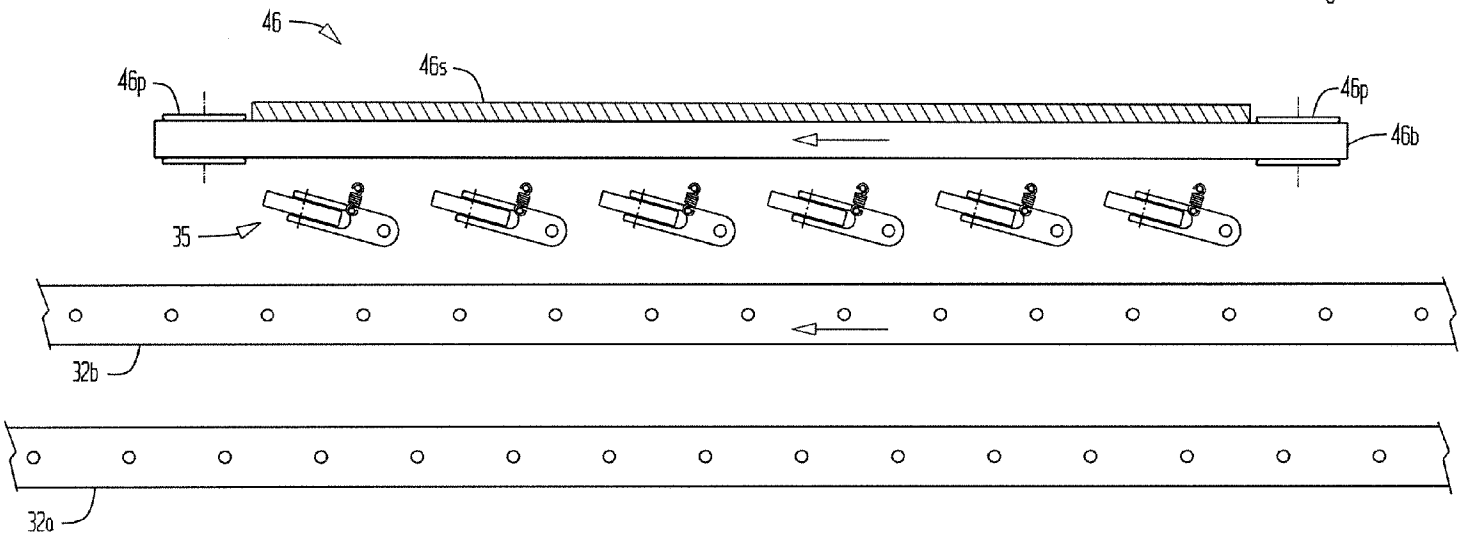
FIG. 4*a* is a schematic top view of an alternative embodiment of the inventive apparatus.

FIG. 4*a* illustrates another embodiment of the invention in which the belt assemblies 32*a* and 32*b* and wheel assemblies 35 are similar to the embodiment of FIG. 3, but the guide 46 is repositioned essentially 90 degrees from that of guide 36 in FIG. 3. That is, pulleys 46*p* rotate about horizontal axes instead of vertical axes. This may be advantageous when it is desired to drive at least one of the pulleys 46*p* because the drive axle is parallel to other axles in the carton folder/gluer and can thus be readily driven with belt drive, for example, whereas the vertical axes of pulleys 36*p* of FIG. 3 may, in that case, need to be driven through a generally more costly right angle gearbox. A stop bar 46*s* is provided to support belt 46*b* against lateral forces so that the guiding edge of belt 46*b* is coincident with target line TL. The edge of the belt 46*b* is generally thicker than a carton blank 11 (not shown in FIG. 4A) and so provides adequate guiding of blank edge 11*e*.

Figure 4B:
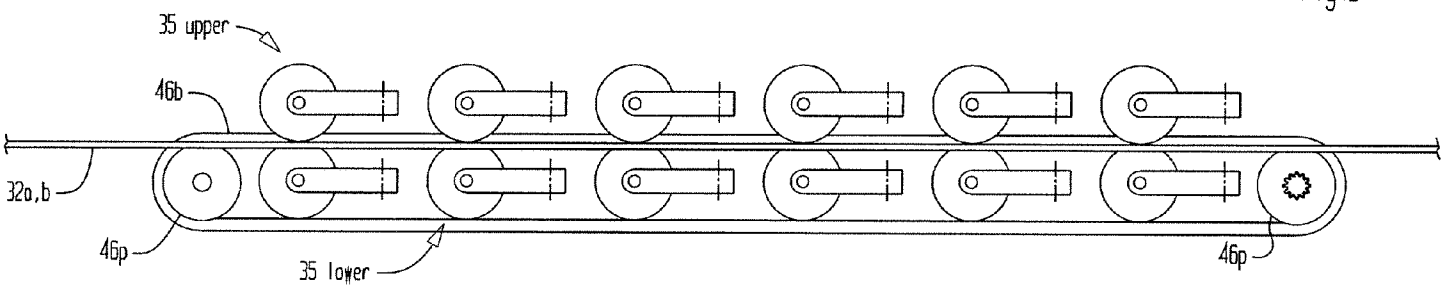
FIG. 4*b* is a schematic side view of the embodiment of FIG. 4*a*.

FIG. 4*b* is a side view of the embodiment of FIG. 4*a* which further shows the upper and lower wheel assemblies, 35 upper and 35 lower. Wheels 35 upper and 35 lower are initially biased as seen in FIG. 4*a*, however, the bias is not clearly visible in the side view of FIG. 4*b*. The upper wheels may be arranged to swing independently of the lower wheels, or may be linked so that each upper and lower wheel pair swings together. In another embodiment, the wheels could be preset at a fixed, i.e., non-swinging, bias or angle. In this embodiment the tires would need to slip laterally in order to prevent buckling the blank 11 due to excessive side force. Such tires could provide a slip angle by means of a pneumatic or otherwise flexible, elastic sidewall construction.

Performance of the aligning apparatus may be adjusted by the machine designer or, where appropriate, the operator. Such adjustments may include:

- The amount of gripping force between the upper and lower wheels, 35 upper and 35 lower. The gripping force may be adjusted by the amount of opposing preload which may be provided by additional springs, not shown, but known in the art of paper handling and carton folding machines, or similarly, elastomeric or pneumatic tires for wheels 35 upper and lower.
- Changing the initial bias angle of the wheels 35.
- Changing the spring constant and/or preload of springs 35*s*.

Figure 5:
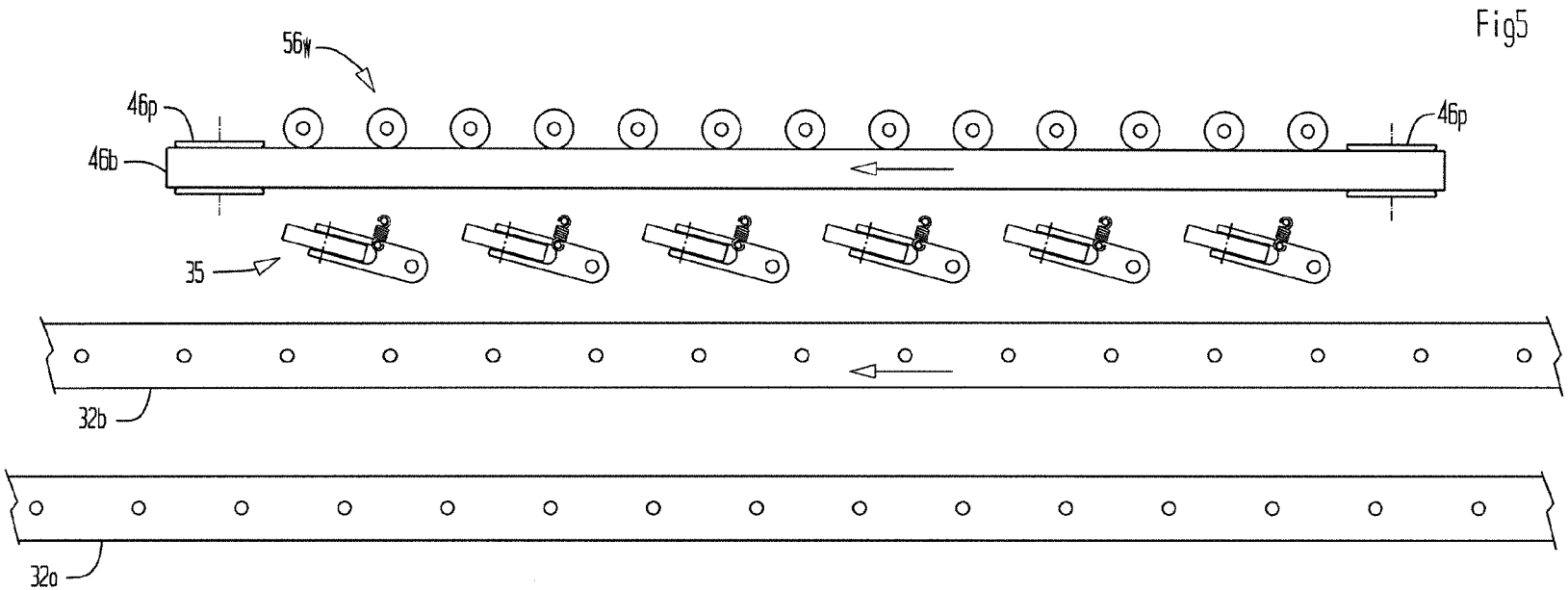
FIG. 5 is a schematic top view of a modification of the embodiment of FIGS. 4*a* and 4*b*.

FIG. 5 illustrates a modification of the embodiment of FIG. 4A where wheels or rollers 56*w* support the guide belt 46*b* instead of stop bar 46*s*. This reduces friction in the mechanism thereby reducing power requirements. Similarly the reduced friction could allow guide belt 46*b* to be 'freewheeling' or idling and thereby driven by contact with edge 11*e* of blanks 11 (not shown in FIG. 5) to more easily drive the guide belt 46*b*. This has potential to reduce the apparatus cost provided it can process blanks 11 of a useful thickness without buckling the blank. In a further modification, the belt 36*b* could be replaced by an array or series of wheels or rollers (not shown).

Figure 6:
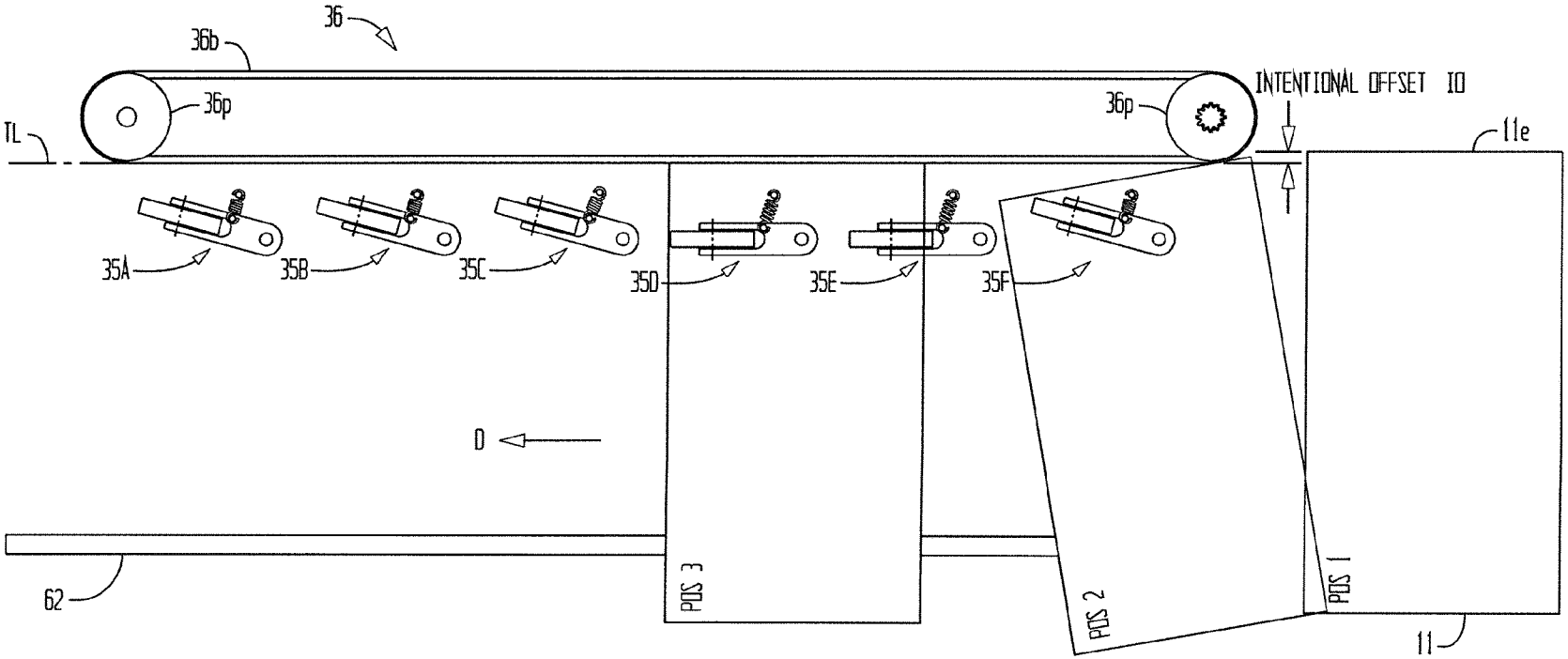
FIG. 6 is a schematic top view of an alternative embodiment of the inventive apparatus.

FIG. 6 illustrates a further embodiment of FIG. 3 in which conveying belts 32*a* and 32*b* may be eliminated because blanks 11 are driven though the aligner by way of driven guide assembly 36 in which belt 36*b* is driven via pulleys 36*p* and blank 11 is forced against belt 36*b* by wheel assemblies 35. In this embodiment, blanks must be inserted into the aligner by a known feeder and the feeder is adjusted to intentionally feed blanks 11 with an offset IO as in Position 1 to assure blank 11 is introduced into the aligning apparatus in firm contact with guide belt 36*b*.

In Position 2, the blank may become somewhat undesirably skewed as a result of the initial offset IO. Wheel assembly 35*f* is shown near its initial bias as it has just engaged blank 11 in Pos. 2. The skewed orientation of Pos. 2 however is quickly corrected by the aligning apparatus as seen in Position 3 where blank 11 is adjusted into the desired orientation and position with edge 11*e* coincident and parallel to target line TL, and wheel assemblies 35D and 35E have accordingly swung into a parallel orientation to the Pos. 3 blank 11 and intended direction D.

Guide bar 62 is a simple metal bar that supports blank 11 from below as is known in the art of carton folder gluers. Guide bar 62 supports blank 11 so it does not droop and so blank 11 remains in an approximately horizontal plane for subsequent transfer to other operations and equipment in, e.g., a carton folder gluer.

While particular embodiments of the present invention have been shown and described, it will be obvious to those skilled in the relevant arts that changes and modifications may be made without departing from the invention in its broader aspects. Therefore, the aim in the appended claims is to cover all such changes and modifications that fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

This invention contemplates a method wherein a sheet-like blank having a lateral edge is conveyed in a general direction and including the steps of;

gripping the blank by at least one pair of wheels, said wheels being mounted at an angle or bias to said general direction;

providing a side force by deflecting the said biased wheels;

shifting the blank against a guide so that the lateral edge is adjusted into a predetermined desired orientation and parallel and coincident with a predetermined target line.

The guide is provided by a moving belt having a face surface and an edge surface and said belt is supported on at least two pulleys.

The moving belt face surface provides an opposing surface for said lateral edge of blank.

The moving belt edge surface provides an opposing surface for said lateral edge of blank.

The belt is driven by at least one pulley.

The guide is provided by a plurality of rollers.

The biased wheels pivot about a caster axis

The biased wheels are mounted at a fixed amount of bias.

A method biased wheels may pivot to provide a variable bias and equipped with a spring to provide a varying side force.

What is claimed is:

1. A method for providing a moving sheet with a predetermined orientation and aligning a linear edge of the moving sheet with an intended direction of travel of the sheet, said method comprising:

conveying the sheet generally in the intended direction of travel;

providing an elongated linear guide member disposed adjacent the moving sheet and having a guide surface aligned and coincident with the intended direction of travel of the sheet, and displacing said guide surface in the intended direction of travel; and gripping the sheet by at least one pair of pivoting deflecting wheels, wherein said wheels are biased at an angle to the intended direction of travel in applying a lateral force to the moving sheet toward said guide member so that the sheet's lateral edge engages the guide member's guide surface and the sheet assumes said predetermined orientation and is displaced in the intended direction of travel, and wherein the angle of said wheels relative to the intended direction of travel decreases as the sheet approaches the intended direction of travel.

2. The method of claim 1, wherein the sheet is conveyed with a vacuum applied to a surface thereof.

3. The method of claim 1, wherein the said lateral force reacts against said guide member's guide surface to provide an assisting longitudinal force aligned with the intended direction of travel when the sheet engages the guide member's said guide surface and moves in the intended direction of travel.

4. The method of claim 1, wherein the sheet includes first and second opposed surfaces, and wherein each of said first and second opposed surfaces is engaged by a respective one of said at least one pair of deflecting wheels, with respective first and second lateral forces applied to said opposed surfaces.

5. The method of claim 1 further comprising the step of determining the position of the sheet during orientating and aligning of the sheet with the intended direction of travel for precise subsequent processing of the sheet.

6. The method of claim 1, wherein the step of gripping the sheet includes firmly engaging the sheet so as to prevent its slippage and provide accurate positioning of the sheet.

7. The method of claim 1 further comprising the step of displacing the guide member's guide surface in the intended direction of travel while engaging the sheet to reduce or eliminate drag on the sheet and urge the sheet in the intended direction of travel.

8. The method of claim 1 further comprising the step of positioning said at least one pair of deflecting wheels in closely spaced relation to said guide member to reduce the possibility of buckling of the sheet when the sheet engages said guide surface.

9. The method of claim 1, wherein said at least one pair of deflecting wheels is movably mounted and capable of pivoting while gripping the sheet.

10. The method of claim 1 further comprising the step of adjusting the biasing of said at least one pair of deflecting wheels and the magnitude of the lateral force applied to the sheet in accordance with the sheet's stiffness to avoid buckling of the sheet when placed in contact with the guide member's guide surface.

11. Apparatus for providing a moving sheet with a predetermined orientation and aligning a flat lateral edge of the moving sheet with an intended direction of travel of the sheet, said apparatus comprising:

a conveyor arrangement for supporting and displacing the sheet generally in the intended direction of travel;

a guide member having a surface aligned and coincident with the intended direction of travel; and a movable deflecting arrangement pivotally biased at an angle relative to the intended direction of travel and engaging and applying a lateral force to the moving sheet toward the guide member so that the sheet's lateral edge engages the guide member's surface and the sheet assumes said predetermined orientation and is displaced in the intended direction of travel, and with the sheet disposed in said predetermined orientation, said movable deflecting arrangement is aligned with the intended direction of travel.

12. The apparatus of claim 11, wherein said conveyor arrangement includes one or more moving apertured vacuum belts attached to the sheet by means of a vacuum applied to the sheet.

13. The apparatus of claim 11, wherein said conveyor arrangement includes plural spaced carrier belts supporting the sheet and attached to the sheet by means of a vacuum applied to the sheet via a space between adjacent belts.

14. The apparatus of claim 11, wherein said guide member has a fixed flat surface disposed adjacent to said conveyor arrangement and adapted to engage the sheet's flat lateral edge.

15. The apparatus of claim 11, wherein said guide member includes a moving element adapted for engaging the sheet's lateral edge and displacing the sheet in the intended direction of travel.

16. The apparatus of claim 15, wherein said moving element is an endless belt supported by plural pulleys.

17. The apparatus of claim 16, wherein said endless belt has at least one flat lateral edge adapted to engage the sheet's lateral edge and displace the sheet in the intended direction of travel.

18. The apparatus of claim 16 wherein said endless belt has an outer flat surface adapted to engage the sheet's lateral edge and displace the sheet in the intended direction of travel.

19. The apparatus of claim 18 further comprising a rigid side guide engaging and maintaining a portion of said moving endless belt in fixed position relative to the sheet.

20. The apparatus of claim 11, wherein said conveyor arrangement includes at least one transport belt supported by plural first pulleys having respective first axes of rotation, and said guide member includes a guide belt supported by plural second pulleys each having respective second axes of rotation, wherein said first and second axes of rotation are parallel.

21. The apparatus of claim 11, wherein said movable deflecting arrangement includes plural casters engaging and applying said lateral force to the moving sheet.

22. The apparatus of claim 21, wherein said plural casters are aligned relative to one another in a spaced manner in the intended direction of travel and are each biased at an angle relative to the intended direction of travel by a respective resilient spring.

23. The apparatus of claim 22, wherein each caster is pivotally mounted ahead, or upstream, of its associated spring and wherein each spring is a coiled spring.

24. The apparatus of claim 21 wherein the sheet includes first and second opposed surfaces, and wherein each of said opposed surfaces is engaged by at least one of said casters, with respective first and second lateral forces applied to said first and second opposed surfaces, respectively.

25. The apparatus of claim 11, wherein said guide member is disposed in closely spaced relation to said conveyor arrangement.

26. The apparatus of claim 25, wherein an edge of the sheet is disposed on said conveyor arrangement with an offset in an overlapping manner with respect to said guide member to allow an edge of the sheet to engage the moving guide member prior to application of the lateral aligning force to the sheet.

* * * * *